United States Patent [19]

Clayton et al.

[11] Patent Number: 5,009,804

[45] Date of Patent: Apr. 23, 1991

[54] GRANULAR LAUNDRY COMPOSITIONS CONTAINING MULTI INGREDIENT COMPONENTS HAVING DISPARATE RATES OF SOLUBILITY

[75] Inventors: Simon N. Clayton, West Jesmond; Peter M. Lambert, Cleckheaton, both of England; Jean Wevers, Grimbergen, Belgium

[73] Assignee: The Procter & Gamble Company, Cincinnati, Ohio

[21] Appl. No.: 351,972

[22] Filed: May 15, 1989

[30] Foreign Application Priority Data

May 13, 1988 [GB] United Kingdom ..... 8811447

[51] Int. Cl.[5] ..... C11D 17/06; C11D 1/12

[52] U.S. Cl. ..... 252/90; 252/95; 252/99; 252/134; 252/174; 252/539; 252/558

[58] Field of Search ..... 252/90, 95, 99, 134, 252/174, 174.21, 539, 558

[56] References Cited

U.S. PATENT DOCUMENTS 4,715,979 12/1987 Moore et al. ..... 252/91

4,849,125 6/1989 Seiter et al. ..... 252/539

FOREIGN PATENT DOCUMENTS 219328 4/1987 European Pat. Off. .

3545947 7/1987 Fed. Rep. of Germany .

*Primary Examiner*—Paul Lieberman

*Attorney, Agent, or Firm*—Fernando A. Borrego; Donald E. Hasse; Thomas H. O'Flaherty

[57] ABSTRACT

Granular laundry detergent compositions are disclosed comprising two separate surfactant-containing components, optionally together with other dry mixed ingredients. The first component, preferably spray dried, contains a slowly-dissolving surfactant in combination with an organic and/or inorganic salt. The surfactant is preferably a long chain ($C_{16+}$) alkyl sulfate or a long chain fatty acid salt. The second component comprises one or more surfactants of higher solubility rate and is preferably formed by agglomeration. Satisfactory release of the compositions from the dispensing compartment of an automatic washing machine can be maintained even when the compositions are of a concentrated high density type.

11 Claims, 7 Drawing Sheets

GRANULAR LAUNDRY COMPOSITIONS CONTAINING MULTI INGREDIENT COMPONENTS HAVING DISPARATE RATES OF SOLUBILITY

The present invention relates to solid detergent compositions More particularly it relates to granular detergent compositions having improved dispensing characteristics i.e. improved elution by water from a product dispenser in an automatic laundry washing machine.

The trend in the modern domestic laundry operation has been, and continues to be, towards an automated process, emPloying relatively small liquid volumes at progressively lower wash temperatures. This trend has been driven by a combination of factors including a need for greater convenience for the user, an increasing emphasis on energy-saving measures and by a growth in the use of coloured fabrics which are not suited to high wash temperatures. Paralleling these developments has been the growth of automated washing machines, mainly of the front loading type, offering a wide range of wash programmes for different fabrics, soil levels and load weights.

A natural consequence of this change in machine design has been that detergent products are no longer added directly to the wash water by the user, but are placed in a pro-duct dispenser compartment in the machine where a flow of water carries them into the washing compartment at the appropriate time.

Laundry detergent compositions have also changed significantly as a result of the developments in machine design and now have controlled suds characteristics with surfactant, detergent builder and oxygen bleach systems designed to work efficiently at lower temperatures Nevertheless the use of smaller wash liquor volumes, lower wash temperatures and shorter wash cycles has placed a premium on the rapid dispersion and/or dissolution of the detergent product in the wash water and this has highlighted a problem arising from the use of the surfactants that are commonly employed in detergent products.

The progressive addition of water to a solid detergent particle composed of, or including, a water soluble surfactant causes the resultant mixture to pass through a succession of states at least one of which is likely to be viscous in character. This may arise because of the nature and/or concentration of the components of the mixture, or may be due to the formation of a viscous surfactant phase, or both. Where the energy of addition during the mixing of the detergent particles and water is intense and/or the volume of water is large relative to the amount of solid detergent particles, the formation of highly viscous mixtures does not significantly influence the rate of solution or dispersion of the product. However where the energy of addition is not intense, and/or the volume of water is low relative to the amount of detergent product present, the formation of viscous mixtures can significantly affect the rate of solution and may even result in incomplete solution of the product.

The design and operation of dispenser compartments in automatic washing machines tends to create conditions which favour the formation of viscous semi-liquid or pasty masses of detergent product. The low surface area of these masses reduces the overall rate of solution of the product and can lead to incomplete flushing of product from the dispenser into the washing compartment This difficulty is more pronounced if the product is concentrated and/or of higher density than conventional detergents.

The problem of inadequate dispensing of detergent products has been recognised in the art. European Published Patent Application No. 0219328 discloses the preparation of a low phosphate spray dried product of low inorganic salt content and coarse particle size to which is added, by postdosing, a relatively high level of sodium sulfate of defined bulk density and particle size distribution. This product is asserted to have superior dispensing characteristics relative to conventional products in commercially available washing machines.

German DOS 3545947 also discloses a product asserted to have improved dispensing capability in which a phosphate-free detergent is formed of at least two powder components, at least one of which is spray dried. The spray dried component (B) comprises one or more anionic surfactants together with constituents that are resistant to spray drying and has a bulk density of 300–500 g/liter. The anionic surfactants can be of the conventional sulphonate, sulfate or fatty acid salt type. The other component (A) comprises a crystalline zeolite, one or more non-ionic surfactants and a carbonic acid homo- or co-polymer of MWT 1000 to 120,000 or the alkali metal salts thereof. This component has an average particle size of 400–800$\mu$ and a bulk density of 500–800 g/liter The two components (A) and (B) are present in a weight ratio of from 1:5 to 3:1 and their particle size distributions differ by no more than 30%.

Another approach to minimising surfactant gel formation particularly in compositions having bulk high density (550–1220 g/dm$^3$) is disclosed in US-A-4715979 assigned to the Applicants. This involves the formation of a base granule comprising from 30% to 85% of a $C_{11}$–$C_{13}$ alkyl benzene sulfonate-$C_{12}$–$C_{16}$ alkyl alkyl sulfate surfactant mixture, an alkali metal silicate in a weight ratio to the surfactant of from 1:1.5 to 1:6, from 10% to 60% of a water-soluble sulfate and from 0% to 20% of a pyrophosphate or anhydrous Form 1 tripolyphosphate, followed by admixture of the base qranules with a detergent builder material, compaction and granulation of the mixture and further admixture of the granulate with additional detergent builder material. Gelling is asserted to be avoided by control of the silicate:surfactant ratio within the recited limits.

Each of these prior art disclosures adopts a different approach to the problem of improving the dispensing of granular detergent compositions in water but all of them seek to do so via increases in the rate of solution of granular detergents containing conventional mixtures of surfactants and builder salts.

It has now been found that the dispensing of granular detergent products from the dispensing containers of automatic washing machines can be significantly improved by taking advantage of the low rate of solubility of certain surfactants This finding is of particular significance in the production of so-called 'concentrated' granular detergent products of high bulk density.

Accordingly the present invention provides a solid detergent composition, wherein said composition is composed of at least two particulate multi ingredient components, a first one of said components comprising a powder incorporating an anionic surfactant in an amount of from about 0.75% to about 30% by weight of the powder and one or more inorganic and/or organic salts in an amount of from about 99.25% to about 70% by weight of the powder, said composition optionally including additional dry mixed heat or chemically-sensitive detergent ingredients wherein;

(a) said first component comprises from about 30% to about 99% by weight of the composition and has a $T_{95}$ *value of from about* 40 to about 180, $T_{95}$ being the lime in seconds to achieve 95% solution of a 1% weight mixture of the component in distilled water at 20° C.;

(b) a second component, constituting from about 1% to about 70% by weight of the composition, comprises a particulate containing a water soluble surfactant; the amounts of (a), (b) and any optional ingredients totalling 100% by weight of the composition, the total composition having a Residue Index of not more than about 30%.

For the purposes of this invention the Residue Index is defined as the percentage by weight of product of defined particle size range remaining after exposure to a water flow of 1.5 liters/minute for 2 minutes at a temperature of 20° C. in a container of size and shape as described hereinafter.

Preferably the first component is a spray dried powder and the second component is a non-spray dried mechanically mixed aggregate, more preferably an agglomerate.

In a particularly preferred embodiment, the surfactant in the first particulate component is sodium tallow alkyl sulfate, and the surfactant in the second component is sodium linear $C_{11-13}$ alkyl benzene sulfonate, preferably in combination with an ethoxylated nonionic surfactant.

The invention will now be described in conjunction with the accompanying drawings in which.

Figure 1:
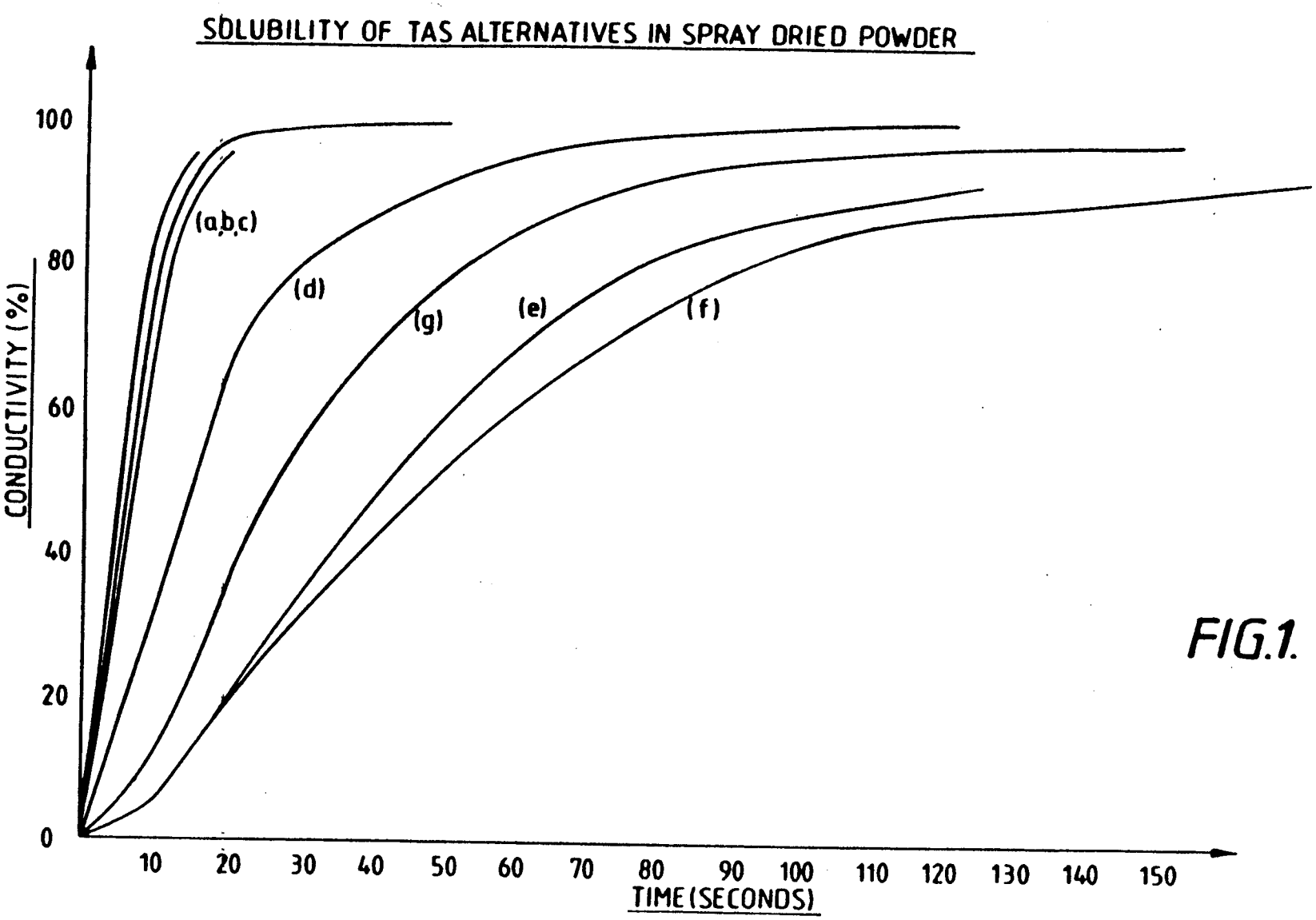
FIG. 1 is a plot of the solution rates of various spray dried detergent powders, as measured by the change in conductivity of the solutions with time.

The solid detergent compositions of the present invention comprise at least two particulate multi ingredient components.

The first component must have a $T_{95}$ value of from about 40 to about 180 seconds, preferably of from about 50 to 150 seconds. As explained more fully hereinafter the $T_{95}$ value is a time in seconds that a 1% wt. sample of the first component takes to achieve 95% solubility in a test carried out in distilled water under controlled conditions.

This first component comprises a particulate incorporating an anionic surfactant in an amount of from about 0.75% to about 30% by weight of the powder and one or more inorganic and/or organic salts in an amount of from about 99.25% to about 70% by weight of the powder. The particulate can have any suitable form such as granules, flakes, prills, marumes or noodles but is preferably granular. The granules themselves may be agglomerates formed by Pan or drum agglomeration or by in-line mixers but are preferably spray dried particles produced by atomising an aqueous slurry of the ingredients in a hot air stream which removes most of the water. For illustrative purposes, the first component is described hereinafter as a spray dried powder as this constitutes a preferred embodiment of the invention.

The first component comprises at least about 30% by weight of the composition, and in the broadest form of the invention may comprise up to about 99% by weight. Preferably however the compositions of the invention include additional dry mixed ingredients so that the first component comprises from about 30% to about 70% more preferably from about 40% to about 60% by weight of the composition.

The primary characteristic of the anionic surfactant in the first component is that it should have a low rate of solubility in aqueous media at the water temperatures that prevail during the fill step of the wash cycle in an automatic washing machine. These temperatures can range from about 5° C. to about 60° C. depending whether or not a 'cold fill' or a 'hot fill' is used. For continental European machines and low temperature wash cycles in UK machines, a 'cold fill' is employed in which the water temperature lies in the range from about 5° C. to about 20° C. more usually from about 7° C. to about 12° C. 'Hot fill' temperatures range from about 35° C. to about 60° C. depending on the machine type and the wash cycle selected. With respect to European wash habits as a whole, 'cold filling' is by far the predominant practice and also gives rise to the highest incidence of residues in dispensing compartments of automatic washing machines.

Suitable anionic surfactants for the purposes of the invention have been found to be linear alkyl sulfate salts in which the alkyl group has from about 15 to about 22 carbon atoms and linear alkyl carboxylate salts in which the alkyl group has an average of from about 16 to about 24 carbon atoms.

Alkyl groups for the alkyl sulfates may be derived synthetically as by OXO synthesis or olefin build-up but are preferably derived from natural fats such as tallow. Shorter chain alkyl sulfates or carboxylates, in which the alkyl group is derived from sources comprising a mixture of alkyl moieties more than 40% of which contain 14 or less carbon atoms, are not suitable for the present invention because they result in T95 values of less than about 40 seconds.

The alkyl groups for the carboxylate salts may be derived synthetically in a similar manner but are also preferably derived from natural sources such as tallow fat or marine oils. The counterion for these salts may be any of the alkali or alkaline earth metals but is preferably sodium for reasons of cost.

The level of anionic surfactant in the spray dried powder forming the first component is from about 0.75% to about 30% by weight, more usually from about 2.5% to about 25% preferably from about 3% to about 15% and most preferably from about 4% to about 10% by weight.

The other major ingredient of the spray dried powder is an inorganic or organic salt that provides the crystalline structure for the granules, the salt being present in an amount of from about 70% to about 99.25% by weight of the powder.

Suitable inorganic salts include the water soluble alkali metal ortho, pyro, tri and higher poly phosphates, as well as carbonates, bicarbonates, sulfates, borates and silicates. Water insoluble salts such as aluminosilicates can also be incorporated.

Preferred inorganic salts are the polyphosphates, sulfates, and where limitations on detergent phosphorous content so require, the synthetic aluminosilicates, more particularly zeolites A, X and B in their fully hydrated forms. Spray dried powders containing these aluminosilicate ion exchange materials preferably do not include alkali metal silicates, particularly those having a high $SiO_2$:$Na_2O$ ratio as the presence of these two materials in aqueous slurries at high temperatures gives rise to undesirable byproducts.

These aluminosilicate ion-exchange materials have the unit cell formula $$M_z[(AlO_2)_z(SiO_2)_y]xH_2O$$

wherein M is a calcium-exchange cation, z and y are at least 6; the molar ratio of z to y is from 1.0 to 0.5 and x is at least 5, preferably from 7.5 to 276, more preferably from 10 to 264. The aluminosilicate materials are in hydrated form and are preferably crystalline containing from 10% to 28%, more preferably from 18% to 22% water.

The above aluminosilicate ion exchange materials are further characterised by a particle size diameter of from 0.1 to 10μ, preferably from 0.2 to 4μ. The term "particle size diameter" herein represents the average particle size diameter of a given ion exchange material as determined by conventional analytical techniques such as, for example, microscopic determination utilizing a scanning electron microscope. The aluminosilicate ion exchange materials are further characterised by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g. The aluminosilicate ion exchange materials herein are still further characterised by their calcium ion exchange rate which is at least about 130 mg equivalent of $CaCO_3$/liter/minute/(gram/liter) [2 grains $Ca^{++}$/gallon/minute/(gram/gallon)]of aluminosilicate (anhydrous basis), and generally lies within the range of from about 130 mg equivalent of $CaCO_3$/liter/minute/(gram/liter) [2 grains/gallon/minute/(gram/gallon)] to about 390 mg equivalent of $CaCO_3$/liter/minute/ (gram/liter) [6 grains/gallon/minute/(gram/gallon)], based on calcium ion hardness. Optimum aluminosilicates for builder purposes exhibit a calcium ion exchange rate of at least about 260 mg equivalent of $CaCO_3$/liter/minute/(gram/liter) [4 grains/gallon/minute/(gram/gallon)].

Aluminosilicate ion exchange materials useful in the practice of this invention are commercially available and can be naturally occurring aluminosilicates or synthetically derived. A method for producing aluminosilicate ion exchange materials is discussed in U.S. Pat. No. 3,985,669. Preferred synthetic crystalline aluminosilicate ion exchange materials useful herein are available under the designation Zeolite A, Zeolite B, Zeolite X, Zeolite HS and mixtures thereof. In an especially preferred embodiment, the crystalline aluminosilicate ion exchange material is Zeolite A and has the formula $$Na_{12}[(AlO_2)_{12}(SiO_2)_{12}]xH_2O$$

wherein x is from 20 to 30, especially 27. Zeolite X of formula $Na_{86}[(AlO_2)_{86}(SiO_2)_{106}]0.276\ H_2O$ is also suitable, as well as Zeolite HS of formula $Na_6[(AlO_2)_6(SiO_2)_6]7.5\ H_2O$).

Suitable organic salts include the organic phosphonates, amino polyalkylene phosphonates, amino polycarboxylates and water soluble organic detergent builder salts. Examples of the latter include water soluble salts of phytic acid, such as sodium and potassium phytates, and water soluble polycarboxylates such as the salts of lactic, succinic, malonic, maleic, citric, carboxymethyloxy succinic, 1,1,2,2, ethane tetracarboxylic, mellitic and pyromellitic acids. Other water soluble organic builder salts include those disclosed in European Published Patent Application Nos. 0137669, 0192441, 0192442 and 0233010 which are hereby incorporated herein by reference.

Mixtures of organic and/or inorganic salts may be used in the spray dried powders forming the first component of the invention.

The organic and/or inorganic salts comprise from about 70% to about 99.25% by weight of the first component, more preferably from about 75% to about 97.5% and most preferably from about 90% to about 96% by weight.

It is preferred that the first component be free or substantially free of surfactants which would, if they were the sole surfactant, give rise to a $T_{95}$ value about ≦40 seconds. However small amounts of such surfactants, i.e. not more than about 10% by weight of the surfactant in the first component may be incorporated provided that the overall $T_{95}$ value of the powder remains greater than about 40 seconds. For example a water soluble nonionic surfactant may be incorporated by spray on to the first component although it is preferred that it be sprayed on to other porous ingredients.

The first component can also include optional ingredients that normally form part of such products. Typical of such optional ingredients are soil suspending agents at about 0.1% to 10% by weight, such as water-soluble salts of carboxymethy-cellulose, carboxyhydroxymethyl cellulose, and polyethylene glycols having a molecular weight of from about 400 to about 10,000. Dyes, pigments, optical brighteners, soil release agents and anticaking agents are also useful components of the spray dried powder component of the present invention and can also be added in varying amounts as desired.

Preferred optical brighteners are anionic in character, examples of which are disodium 4,4$^1$-bis-(2-diethanolamino-4-anilino -s- triazin-6-ylamino)stilbene-2:2$^1$ disulphonate, disodium 4, 4$^1$-bis-(2-morpholino-4-anilino-s-triazin-6-ylaminostilbene-2:2$^1$ - disulphonate, disodium 4, 4$^1$-bis-(2,4-dianilino-s-triazin-6-ylamino)stilbene-2:2$^1$-disulphonate monosodium 4$^1$,4$^{11}$ -bis-(2,4-dianilino-s-triazin-6-ylamino)stilbene-2-sulphonate, disodium 4,4$^1$ -bis-(2-anilino-4-(N-methylN-2-hydroxyethylamino)-s-triazin-6-yl amino)stilbene-2,2$^1$ - disulphonate, disodium 4,4$^1$ -bis-(4-phenyl-2,1,3-triazol-2-yl)-stilbene-2,2$^1$ disulphonate, disodium,4$^1$bis(2-anilino-4-(l-methyl-2-hydroxyethylamino)-s-triazin-6-ylamino)-stilbene-2,2$^1$ disulphonate and sodium 2(stilbyl-4$^{11}$-(naphtho-1$^1$, 2$^1$:4,5)-1,2,3 - triazole-2$^{11}$-sulphonate.

Soil release agents useful in compositions of the present invention are conventionally copolymers or terpolymers of terephthalic acid with ethylene glycol and/or propylene glycol units in various arrangements. Examples of such polymers are disclosed in the commonly assigned U.S. Pat. Nos. 4116885 and 4711730 and European Published Patent Application No. 0272033 the disclosures of all of which are incorporated herein by reference.

A particularly preferred polymer in accordance with EP-A-0272033 has the formula $$(CH_3(PEG)_{43})_{0.75}(POR)_{0.25}[(T—PO)_{2.8}\text{-}(T—PEG)_{0.4}]T(PO—H)_{0.25}$$

$$((PEG)_{43}CH_3)_{0.75}$$

where PEG is $—(OC_2H_4)O—$, PO is $(OC_3H_6O)$ and T is $(pCOC_6H_4CO)$.

In preferred compositions where the first component is a spray dried powder, optional ingredients included in the first component should be heat stable to the extent necessary to withstand the temperatures encountered in the spray drying process. Where spray dried powder forms the first component of the compositions of the invention it will normally be dried to a moisture content of from about 8 to about 15% by weight, more preferably from about 7 to about 13% by weight of the spray dried powder. Moisture contents of powders produced by other processes such as agglomeration may be lower and can be in the range 1–10% by weight.

The particle size of the powder is conventional in that the particles should be neither excessively coarse or fine. Thus preferably not more than about 5% by weight should be above 1.4 mm in maximum dimension while not more than about 10% by weight should be less than about 0.15 mm in size. Preferably at least about 60% and most preferably at least about 80% by weight of the powder lies between 0.7 mm and 0.25 mm in size. For spray dried powders, the bulk density of the particles can range from about 350 g/liter to about 650g/liter but conventionally lies in the range 540 to 600 g/liter. Bulk densities in the upper part of the range from 600–650 g/liter are particularly useful where production of so called concentrated products is desired. However, bulk densities above this range may be produced if processes other than spray drying are used and highly concentrated products are desired.

The second component of the invention is a particulate containing a water soluble surfactant. By "water-soluble" is meant a surfactant that would have a $T_{95}$ value of about $\leqq 40$ seconds in a powder incorporating the anionic surfactant in an amount of from about 0.75% to about 30% by weight of the powder and one or more inorganic and/or organic salts in an amount from about 99.25% to about 70% by weight of the powder.

The second component may have any suitable physical form i.e. it may take the form of flakes, prills, marumes, noodles, ribbons, or granules which may be spray-dried or non spray-dried agglomerates. Although the second component could in theory comprise the water soluble surfactant on its own, in practice at least one organic or inorganic salt is included to facilitate processing.

The second component comprises from about 1% to about 70% by weight of the detergent composition and preferably forms less than about 50% by weight. In highly preferred embodiments of the invention the second component forms less than about 30% of the composition and one or more additional dry mixed ingredients are also present.

The water soluble surfactant of the second component may be anionic, nonionic, cationic, or semi polar or a mixture of any of these.

Suitable synthetic anionic surfactants are water-soluble salts of alkyl benzene sulfonates, alkyl sulfates, alkyl polyethoxy ether sulfates, paraffin sulfonates, alpha-olefin sulfonates, alpha-sulfo-carboxylates and their esters, alkyl glyceryl ether sulfonates, fatty acid monoglyceride sulfates and sulfonates, alkyl phenol polyethoxy ether sulfates, 2-acyloxy-alkane-1-sulfonate, and beta-alkyloxy alkane sulfonate.

A particularly suitable class of anionic surfactants includes water-soluble salts, particularly the alkali metal, ammonium and alkanolammonium salts or organic sulfuric reaction products having in their molecular structure an alkyl or alkaryl group containing from about 8 to about 22, especially from about 10 to about 20 carbon atoms and a sulfonic acid or sulfuric acid ester group.

(Included in the term "alkyl" is the alkyl portion of acyl groups). Examples of this group of synthetic detergents which form part of the detergent compositions of the present invention are the sodium and potassium alkyl sulfates, especially those obtained by sulfating $C_8$–$C_{14}$ alcohols produced synthetically or by reducing the glycerides of coconut oil and sodium and potassium alkyl benzene sulfonates, in which the alkyl group contains from about 9 to about 15, especially about 11 to about 13, carbon atoms, in straight chain or branched chain configuration, e.g. those of the type described in U.S. Pat. Nos. 2,220,099 and 2,477,383 and those prepared from alkylbenzenes obtained by alkylation with straight chain chloroparaffins (using aluminium trichloride catalysis) or straight chain olefins (using hydrogen fluoride catalysis). Especially valuable are linear straight chain alkyl benzene sulfonates in which the average of the alkyl group is about 11.8 carbon atoms, abbreviated as $C_{11.8}$ LAS.

Other anionic detergent compounds herein include the sodium $C_{10\text{-}18}$ alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Other useful anionic detergent compounds herein include the water-soluble salts or esters of $\alpha$-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; alkyl ether sulfates containing from about 10 to 18, especially about 12 to 16, carbon atoms in the alkyl group and from about 1 to 12, especially 1 to 6, more especially 1 to 4 moles of ethylene oxide; water-soluble salts of olefin sulfonates containing from about 12 to 18, preferably about 14 to 16, carbon atoms, especially those made by reaction with sulfur trioxide followed by neutralization under conditions such that any sulfones present are hydrolysed to the corresponding hydroxy alkane sulfonates; water-soluble salts of paraffin sulfonates containing from about 8 to 20 , especially 14 to 18 carbon atoms, and $\beta$-alkyloxy alkane sulfonates containing from about 1 to 3 carbon atoms in the alkyl group and from about 8 to 20 carbon atoms in the alkane moiety.

The alkane chains of the foregoing non-soap anionic surfactants can be derived from natural sources such as coconut oil or tallow, or can be made synthetically as for example using the Ziegler or Oxo processes. Water solubility can be achieved by using alkali metal, ammonium or alkanolammonium cations; sodium is preferred.

Mixtures of any of the foregoing anionic surfactants can also be used.

Alkoxylated nonionic surfactants are also suitable for incorporation in the second component and can be broadly defined as compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Examples of suitable nonionic detergents include:

1. The polyethylene oxide condensates of alkyl phenol, e.g. the condensation products of alkyl phenols having an alkyl group containing from 6 to 12 carbon atoms in either a straight chain or branched chain configuration, with ethylene oxide, the said ethylene oxide being present in amounts equal to 5 to 15 moles of ethylene oxide per mole of alkyl phenol. The alkyl substituent in such compounds may be derived, for example, from polymerised propylene, di-isobutylene, octene and nonene Other examples include dodecylphenol condensed with 9 moles of ethylene oxide per mole of phenol; dinonylphenol condensed with 11 moles of ethylene oxide per mole of phenol; nonylphenol and di-isooctylphenol condensed with 12 moles of ethylene oxide.

2 The condensation product of primary or secondary aliphatic alcohols having from 8 to 24 carbon atoms, in either straight chain or branched chain configuration, with from 1 to about 18 moles of alkylene oxide per mole of alcohol. Preferably, the aliphatic alcohol comprises between 9 and 15 carbon atoms and is ethoxylated with between 2 and 12, desirably between 3 and 9 moles of ethylene oxide per mole of aliphatic alcohol. Such nonionic surfactants are preferred from the point of view of providing good to excellent detergency performance on fatty and greasy soils, and in the presence of hardness sensitive anionic surfactants such as alkyl benzene sulfonates. The preferred surfactants are prepared from primary alcohols which are either linear (such as those derived from natural fats or, prepared by the Ziegler process from ethylene, e.g. myristyl, cetyl, stearyl alcohols), or partly branched such as the Dobanols and Neodols which have about 25% 2-methyl branching (Dobanol and Neodol being Trade Names of Shell) or Synperonics, which are understood to have about 50% 2-methyl branching (Synperonic is a Trade Name of I.C.I.) or the primary alcohols having more than 50% branched chain structure sold under the Trade Name Lial by Liquichimica. Specific examples of nonionic surfactants falling within the scope of the invention include Dobanol 45-4, Dobanol 45-7, Dobanol 45-9, Dobanol 91-3, Dobanol 91-6, Dobanol 91-8, Synperonic 6, Synperonic 14 and the condensation products of coconut alcohol with an average of between 5 and 12 moles of ethylene oxide per mole of alcohol, the coconut alkyl portion having from 10 to 14 carbon atoms. Secondary linear alkyl ethoxylates are also suitable in the present compositions, especially those ethoxylates of the Tergitol series having from about 9 to 15 carbon atoms in the alkyl group and up to about 11, especially from about 3 to 9, ethoxy residues per molecule.

3. The compounds formed by condensing ethylene oxide with a hydrophobic base formed by the condensation of propylene oxide with propylene glycol. The molecular weight of the hydrophobic portion generally falls in the range of about 1500 to 1800. Such synthetic nonionic detergents are available on the market under the Trade Name of "Pluronic" supplied by Wyandotte Chemicals Corporation.

Of the above, highly preferred are alkoxylated nonionic surfactants having an average HLB in the range from about 9.5 to 13.5, especially 10 to 12.5. Highly suitable nonionic surfactants of this type are ethoxylated primary or secondary $C_{9-15}$ alcohols having an average degree of ethoxylation from about 3–9, more Preferably from about 5 to 8.

Suitable water-soluble cationic surfactants are those having a critical micelle concentration for the pure material of at least 200 p.p.m. and preferably at least 500 p.p.m. specified at 3O° C. and in distilled water. Literature values are taken where possible, especially surface tension or conductimetric values—see Critical Micelle Concentrations of Aqueous Surfactant System, P. Mukerjee and K. J. Mysels, NSRDS—NBS 36 (1971).

A highly preferred group of cationic surfactants of this type have the general formula:

$$R^1{}_mR^2{}_{4-m}N\ Z$$

wherein $R^1$ is selected from $C_8$–$C_{20}$ alkyl, alkenyl and alkaryl groups; $R^2$ is selected from $C_1$–$C_4$ alkyl and benzyl groups; Z is an anion in number to give electrical neutrality; and m is 1, 2 or 3; provided that when m is 2 $R^1$ has less than 15 carbon atoms and when m is 3, $R^1$ has less than 9 carbon atoms.

Where m is equal to 1, it is preferred that $R^2$ is a methyl group. Preferred compositions of this monolong chain type include those in which $R^1$ is a $C_{10}$ to $C_{16}$ alkyl group. Particularly preferred compositions of this class include $C_{12}$ alkyl trimethylammonium halide and $C_{14}$ alkyl trimethylammonium halide.

Where m is equal to 2, the $R^1$ chains should have less than 14 carbon atoms. Particularly preferred cationic materials of this class include di-$C_8$ alkyldimethylammonium halide and di-$C_{10}$ alkyldimethylammonium halide materials.

Where m is equal to 3, the $R^1$ chains should be less than 9 carbon atoms in length. An example is trioctyl methyl ammonium chloride.

Another highly preferred group of cationic compounds have the general formula:

$R^1R^2{}_mR^3{}_{3-m}N^+A$ wherein $R^1$ represents a $C_{6-24}$ alkyl or alkenyl group or a $C_{6-12}$ alkaryl group, each $R^2$ independently represents a $(C_nH_{2n}O)_xH$ group where n is 2, 3 or 4 and x is from 1 to 14, the sum total of $C_nH_{2n}O$ groups in $R^2{}_m$ being from 1 to 14, each $R^3$ independently represents a $C_{1-12}$ alkyl or alkeny group, an aryl group or a $C_{1-6}$ alkaryl group, m is 1, 2 or 3, and A is an anion.

In this group of compounds, $R^1$ is selected from $C_{6-24}$ alkyl or alkenyl groups and $C_{6-12}$ alkaryl groups; $R^3$ is selected from $C_{1-12}$ alkyl or alkenyl groups and $C_{1-6}$ alkaryl groups. When m is 2, however, it is preferred that the sum total of carbon atoms in $R^1$ and $R^3{}_{3-m}$ *is no more than about* 20 with $R^1$ representing a $C_{8-18}$ alkyl or alkenyl group More preferably the sum total of carbon atoms in $R^1$ and $R^1_{3-m}$ is no more than about 17 with $R^1$ representing a $C_{10-16}$ alkyl or alkenyl group. When m is 1, it is again preferred that the sum total of carbon atoms in $R^1$ and $R^3_{3-m}$ is no more than about 17 with $R^1$ representing a $C_{10-16}$ or alkaryl group.

Additionally in this group of compounds, the total number of alkoxy radicals in polyalkoxy groups ($R^2_m$) directly attached to the cationic charge center should be no more than 14. Preferably, the total number of such alkoxy groups is from 1 to 7 with each polyalkoxy group ($R^2$) independently containing from 1 to 7 alkoxy groups; more preferably, the total number of such alkoxy groups is from 1 to 5 with each polyalkoxy group ($R^2$) independently containing from 1 to 3 alkoxy groups. Especially preferred are cationic surfactants having the formula:

$$R^1\,(C_nH_{2n}OH)_m\,(CH_3)_{3m}N\,A$$

wherein $R^1$ is as defined immediately above, n is 2 or 3 and m is 1, 2 or 3.

Particularly preferred cationic surfactants of the class having m equal to 1 are dodecyl dimethyl hydroxyethyl ammonium salts, dodecyl dimethyl hydroxypropyl ammonium salts, myristyl dimethyl hydroxyethyl ammonium salts and dodecyl dimethyl dioxyethylenyl ammonium salts. When m is equal to 2, particularly preferred cationic surfactants are dodecyl dihydroxyethyl methyl ammonium salts, dodecyl dihydroxypropyl methyl ammonium salts, dodecyl dihydroxyethyl ethyl ammonium salts, myristyl dihydroxyethyl methyl ammonium salts, cetyl dihydroxyethyl methyl ammonium salts, stearyl dihydroxyethyl methyl ammonium salts, oleyldihydroxyethyl methyl ammonium salts, and dodecyl hydroxy ethyl hydroxypropyl methyl ammonium salts. When m is 3, particularly preferred cationic surfactants are dodecyl trihydroxyethyl ammonium salts, myristyl trihydroxyethyl ammonium salts, cetyl trihydroxyethyl ammonium salts, stearyl trihydroxyethyl ammonium salts, oleyl trihydroxy ethyl ammonium salts, dodecyl dihydroxyethyl hydroxypropyl ammonium salts and dodecyl trihydroxypropyl ammonium salts.

In the above, the usual inorganic salt counterions can be employed, for example, chlorides, bromides and borates. Salt counterions can also be selected from organic acid anions, however, such as the anions derived from organic sulphonic acids and from sulphuric acid esters. A preferred example of an organic acid anion is a $C_{6-12}$ alkaryl sulphonate.

Of all the above cationic surfactants, especially preferred are dodecyl dimethyl hydroxyethyl ammonium salts and dodecyl dihydroxyethyl methyl ammonium salts.

Suitable surfactants of the amine oxide class have the general formula

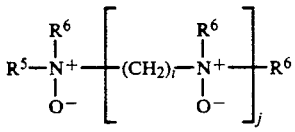

wherein $R^5$ is a linear or branched alkyl or alkenyl group having 8 to 20 carbon atome, each $R^6$ is independently selected from $C_{1-4}$ alkyl and $-(C_nH_{2n}O)_mH$ where i is an integer from 1 to 6, j is 0 or 1, n is 2 or 3 and m is from 1 to 7, the sum total of $C_nH_{2n}O$ groups in a molecule being no more than 7.

In a preferred emdodiment $R^5$ has from 10 to 14 carbon atoms and each $R^6$ is independently selected from methyl and $-(C_nH_{2n}O)_mH$ wherein m is from 1 to 3 and the sum total of $C_nH_{2n}O$ groups in a molecule is no more than 5, preferably no more than 3. In a highly preferred embodiment, j is 0 and each $R^6$ is methyl, and $R^5$ is $C_{12}$–$C_{14}$ alkyl.

Another suitable class of amine oxide species is represented by bis-amine oxides having the following substituents.

j:1

$R^5$: tallow $C_{16}$–$C_{18}$ alkyl: palmityl: oleyl: stearyl $R^6$: hydroxyethyl i: 2 or 3

A specific example of this preferred class of bis-amine oxides is: N-hydrogenated $C_{16}$–$C_{18}$ tallow alkyl-N,N',N'tri-(2-hydroxyethyl) -proxylene-1,3-diamine oxide.

The second component normally comprises at least one organic or inorganic salt in addition to the water soluble surfactant. This provides a degree of crystallinity, and hence acceptable flow characteristics, to the particulate and may be any one or more of the organic or inorganic salt compounds present in the first component.

In preferred compositions the second component incorporates an alkali metal or alkaline earth metal silicate in an amount from about 0.5% to about 10% preferably from about 2.0 to about 8% and most preferably from about 3.0% to about 6% by weight of the composition. The level of silicate in the component will, of course, depend on the amount of the second component which is employed, but will generally be in the range 10%–30% by weight. Suitable silicate solids have a molar ratio of $SiO_2$:alkali metal$_2$O in the range of from about 1.0 to about 4.0:1, more preferably from about 1.6 to about 3.5:1. Preferred compositions in accordance with the invention also include a level of alkali metal carbonate in the second component in an amount of from about 3% to about 12% by weight of the composition, more preferably from about 5% to about 10% by weight. This will provide a level of carbonate in the second component of from about 20% to about 40%.

A highly preferred ingredient of the second component is a water insoluble aluminosilicate ion exchange material of the zeolite type, as described hereinbefore. When utilised in the second component the level of incorporation of these water insoluble aluminosilicate materials is from about 1% to about 10% by weight of the composition, more preferably from about 2% to about 8% by weight. If the second component is spray dried, it is important that it does not contain silicate and alumino silicate ingredients for the reasons stated hereinbefore. In such circumstances, the silicate may be incorporated in the first component or added as a post dosed material, together with the other dry mixed materials to the first and second components.

The particle size range of the second component is not critical but should be such as to obviate segregation from the particles of the spray dried first component when blended therewith. Thus not more than about 5% by weight should be above 1.4 mm in maximum dimension while not more than about 10% should be less than about 0.15 mm in size The bulk density of the second component will be a function of its mode of preparation Thus, in spray dried granular form the second component may have a density of from about 350 g/liter to about 650 g/liter but more preferably will be in the range from about 500 g/liter to about 630 g/liter. The preferred form of the second component however is a mechanically mixed agglomerate which may be made by adding the ingredients dry or with an agglomerating agent to a pan agglomerator, Z blade mixer or more preferably an in-line mixer such as those manufactured by Schugi Holland , 29 Chroomstraat 8211 AS, Lelystad, Netherlands and Gebruder Lodige Maschinenbau GmbH, D-4790 Paderborn 1, Elsenerstrasse 7-9, Postfach 2050 F.R.G. By this means the second component can be given a bulk density in the range from 650 g/liter to 1190 g/liter, more preferably from 750 g/liter to 850 g/liter. This is particularly useful in formulating the so called 'concentrated' products In a further preferred embodiment of the second component the particles of agglomerated material are provided with a coating of fine particles of the spray dried first component, these particles being of a size less than 150μ preferably less than 100μ.

Preferred compositions in accordance with the invention also incorporate one or more dry mixed ingredients in addition to the first and second particulate components Thus the compositions preferably contain one or more of particulate inorganic peroxy bleaches, peroxy carboxylic acid precursors (bleach activators), suds suppressors, polymeric soil release agents, enzyme, photoactivated bleaches and may also contain fabric softening agents and dye materials.

Particulate inorganic peroxy bleaches are normally incorporated in an amount of from about 3% to about 40% by weight, more preferably from about 8% to about 25% by weight and most preferably from about 12% to about 20% by weight of the compositions Examples of suitable bleaches include sodium perborate monohydrate and tetrahydrate, sodium percarbonate and persulfate, persilicate and perphosphate materials. Sodium perborate tetrahydrate and monohydrate and mixtures thereof are particularly preferred.

A preferred dry mixed ingredient is also a peroxy carboxylic acid bleach precursor, commonly referred to as a bleach activator which is preferably added in a prilled or agglomerated form. Examples of suitable compounds of this type are disclosed in British Patent Nos. 1586769 and 2143231 and a method for their formation into a prilled form is described in European Published Patent Application No. 0062523, all of these disclosures being incorporated herein by reference. Preferred examples of such compounds are tetracetyl ethylene diamine and sodium 3, 5, 5 trimethyl hexanoyloxybenzene sulphonate.

Bleach activators are normally employed at levels of from about 0.5% to about 10% by weight, more preferably from about 1% to about 5% by weight of the composition.

Another optional ingredient is a suds suppressor, exemplified by silicones, and silica-silicone mixtures.

U.S. Pat. No. 3,933, 672 issued Jan. 20, 1976, to Bartollota et al., discloses a silicone suds controlling agent. The silicone material can be represented by alkylated polysiloxane materials such as silica aerogels and xerogels and hydrophobic silicas of various types. The silicone material can be described as siloxane having the formula:

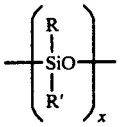

wherein x is from about 20 to about 2,000 and R and R' are each alkyl or aryl groups, especially methyl, ethyl, propyl, butyl and phenyl The polydimethylsiloxanes (R and R' are methyl) having a molecular weight within the range of from about 200 to about 2,000,000, and higher, are all useful as suds controlling agents. Additional suitable silicone materials wherein the side chain groups R and R' are alkyl, aryl, or mixed alkyl or aryl hydrocarbyl groups exhibit useful suds controlling properties. Examples of the like ingredients include diethyl-, dipropyl-, dibutyl-, methyl-, ethyl-, phenylmethylpolysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2/g$. intimately admixed with dimethyl silicone fluid having a molecular weight in the range from about 500 to about 200,000 at a weight ratio of silicone to silanated silica of from about 1:1 to about 1:2. The silicone suds suppressing agent is advantageously releasably incorporated in a water-soluble or water-dispersible, substantially non-surface-active detergent-impermeable carrier.

Particularly useful suds suppressors are the selfemulsifying silicone suds suppressors, described in German Patent Application DTOS 2,646,126 published April 28, 1977 An example of such a compound is DC-544, commercially copolymer.

The suds suppressors described above are normally employed at levels of from 0.01% to 0.5% by weight of the composition, preferably from 0.01% to 0.1% by weight. While they can be incorporated into the particulates of the present invention it is preferred that they be formed into separate particulates that can then be mixed with the particulates of the invention. The incorporation of the suds modifiers as separate particulates also permits the inclusion therein of other suds controlling materials such as $C_{20}$–$C_{24}$ fatty acids, microcrystalline waxes and high MWt copolymers of ethylene oxide and propylene oxide which would otherwise adversely affect the dispersibility of the matrix. Techniques for forming such suds modifying particulates are disclosed in the previously mentioned Bartolotta et al U.S. Pat. No. 3,933,672.

Preferred soil suspending and anti-redeposition agents include methyl cellulose derivatives and the copolymers of maleic anhydride and either methyl vinyl ether or ethylene.

Another class of stain removal additives useful in the present invention are enzymes.

Preferred enzymatic materials include the commercially available amylases, and neutral and alkaline proteases conventionally incorporated into detergent compositions. Suitable enzymes are discussed in U.S. Pat. Nos. 3,519,570 and 3,533,139.

Compositions in accordance with the invention can also contain fabric softening agents of the types disclosed in published European Patent Application No. 0026528, 0210704, 0242919 and 0252551 and copending European Application No. 87202157.1, all of these disclosures being incorporated herein by reference.

In compositions containing such fabric softening ingredients, the smectite clay material is preferably dry mixed while any water insoluble amine and cationic surfactant materials form part of the second component. Any poly (ethylene oxide) material is preferably incorporated in the particulate forming the first component.

The rate of solubility of the first component is a critical parameter of the present invention as it has a major influence on the dispensing characteristics of the product. It has been found that this solubility rate can be correlated with the time in seconds ($T_{95}$) that a sample of the particulate takes to achieve 95% solubility in a beaker test. This test is carried out as follows:

A 1 liter glass beaker is filled with 800 ml distilled water at 20° C. and agitated using a magnetic stirrer set at approximately 150 rpm. A conductivity probe is inserted into the beaker, 8g of product of particle size p where 0.42 mm >p>0.25mm is added and a profile of conductivity vs time is then measured. The conductivity value measured at the 10 minute point is taken to represent 100% solubility and the time in seconds to reach 95% of this value is determined and recorded as the $T_{95}$ value.

FIG. 1 is a plot of solution rates of various spray dried detergent powders measured in the above manner. The detergent powders, identified as (a)-(g) had the common framework formulation shown below in which the level and type of organic surfactant were the only variables,

| | Wt % |
|---|---|
| Surfactant* | 1.6–3.9 |
| STPP | 37.0 |
| Sodium silicate ($SiO_2$ $Na_2O$ = 1.6:1) | 14.8 |
| Maleic anhydride acrylate copolymer MWT 60,000 | 2.8 |
| Moisture | 11.0 |
| Sodium sulfate | up to 100 |

The results show that the $T_{95}$ values for powders (a) (b) and (c) were less than 20 seconds whereas the $T_{95}$ values for powders (d)-(g) inclusive were greater than 50 seconds.

*(a) 1.6% sodium $C_{11.8}$ linear alkyl benzene sulfonate, +1.4% polydimethyl siloxane (DC200 manufactured by Dow Corning Inc.)

(b) 1.7% sodium linear alkyl benzene sulfonate (c) 2.1% Micro-crystalline wax (d) 2.9% sodium stearate (e) 3.05% sodium $C_{18}$–$C_{22}$ hydrogenated fatty acid carboxylate (neutralised offline)

(f) 3.4% $C_{18}$–$C_{22}$ hydrogenated fatty acid (g) 3.9% sodium tallow alcohol sulfate As will be shown later, products which have a $T_{95}$ value of less than about 40 seconds do not display satisfactory dispensing characteristics, whereas those having a $T_{95}$ value in the range 40–180 seconds dispense satisfactorily. It is preferred that the $T_{95}$ value should be greater than about 50 seconds but $T_{95}$ values in excess of about 180 seconds, although satisfactory from a dispensing standpoint, do not dissolve sufficiently rapidly to function adequately in a normal wash cycle.

Figure 2:
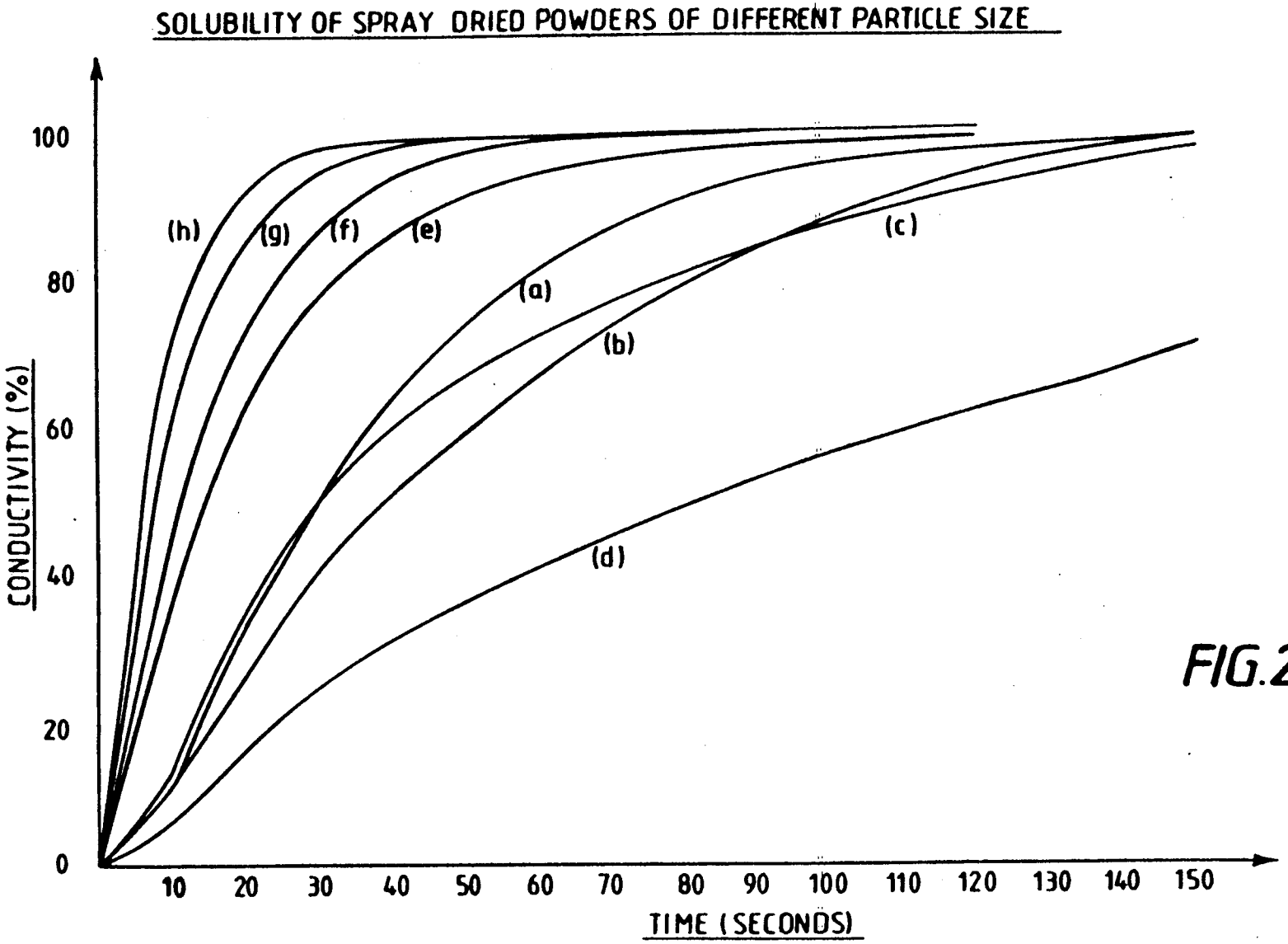
FIG. 2 is a similar plot to that of FIG. 1 in which the effect of particle size range on the solution rates of two different spray dried detergent powders are compared.

FIG. 2 is a similar plot to that of FIG. 1 in which the effect of powder particle size fractions on the rate of solution is plotted for two spray-dried powders (a),(b),(c),(d) and (e),(f),(g),(h) respectively containing 6.18% sodium tallow alkyl sulfate and 8.3% $C_{11.8}$ linear alkyl benzene sulfonate as surfactants. The $T_{95}$ values for each of the size fractions of each powder are shown below:

| Sample | Particle size p mm | $T_{95}$ seconds |
|---|---|---|
| (a) | p > 0.699 | 99 |
| (b) | 0.699 > p > 0.422 | 125 |
| (c) | 0.422 > p > 0.25 | 138 |
| (d) | 0.25 > p | 420 |
| (e) | p > 0.699 | 67 |
| (f) | 0.699 > p > 0.422 | 43 |
| (g) | 0.422 > p > 0.25 | 31 |
| (h) | 0.25 > p | 24 |

It can be seen that for each size fraction the tallow alkyl sulfate powder dissolves more slowly than the corresponding alkyl benzene sulfonate powder and the surfactant type is more important than the particular size fraction is determining solution behaviour.

Figure 3:
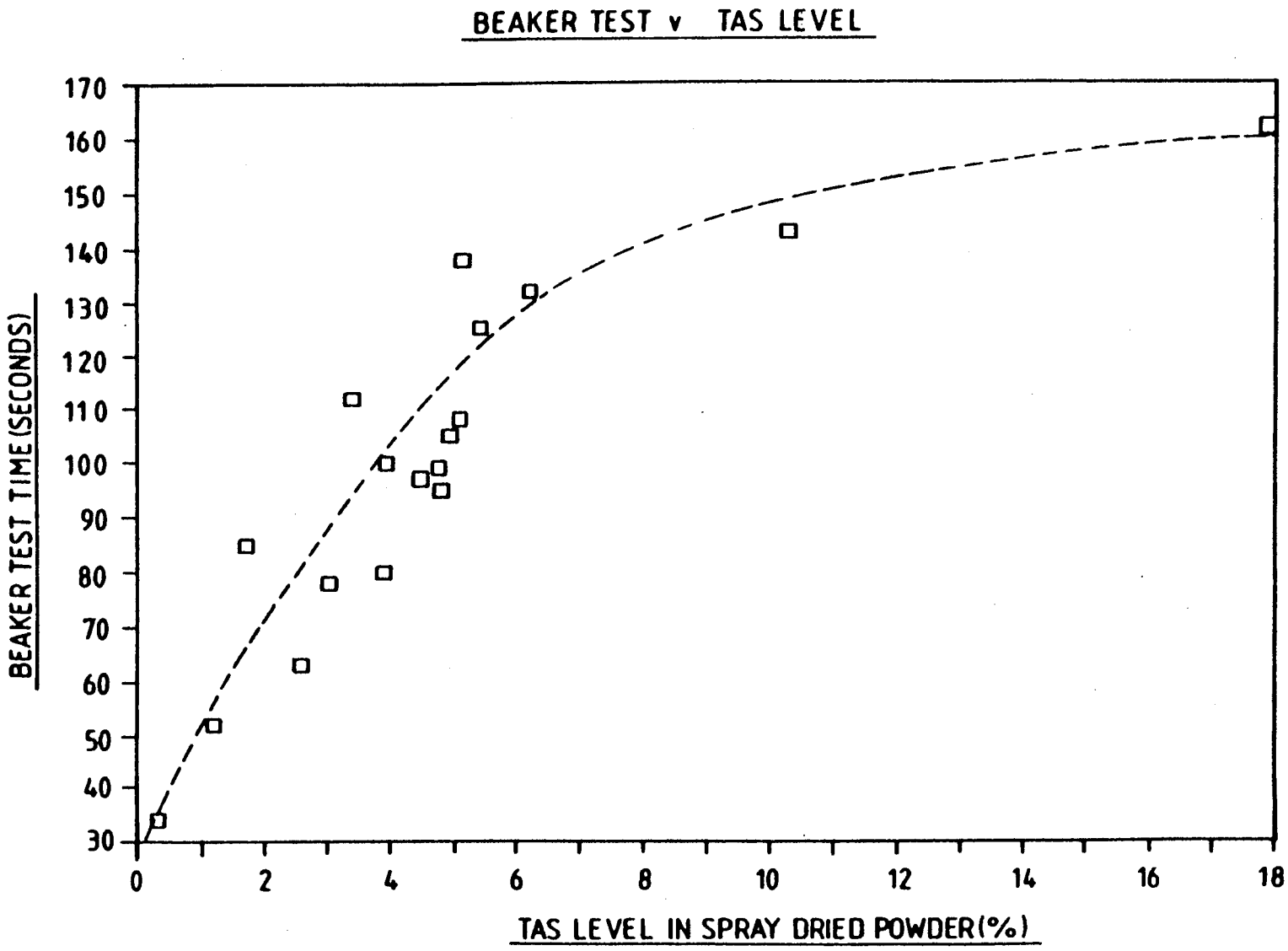
FIG. 3 is a plot of the effect on the time to reach 95% solubility ($T_{95}$) of changes in sodium tallow alkyl sulfate level in a spray dried detergent powder.

FIG. 3 shows that a minimum level of approximately 0.75% by weight of Tallow alkyl sulfate in a spray dried powder is necessary to achieve a $T_{95}$ value of 40 seconds but that above approximately 10% by weight little additional benefit is obtained. Indeed, $T_{95}$ values in excess of approximately 180 seconds are believed to be disadvantageous because they are predictive of incomplete solution of the product during the actual wash stage of the washing cycle.

Figure 4:
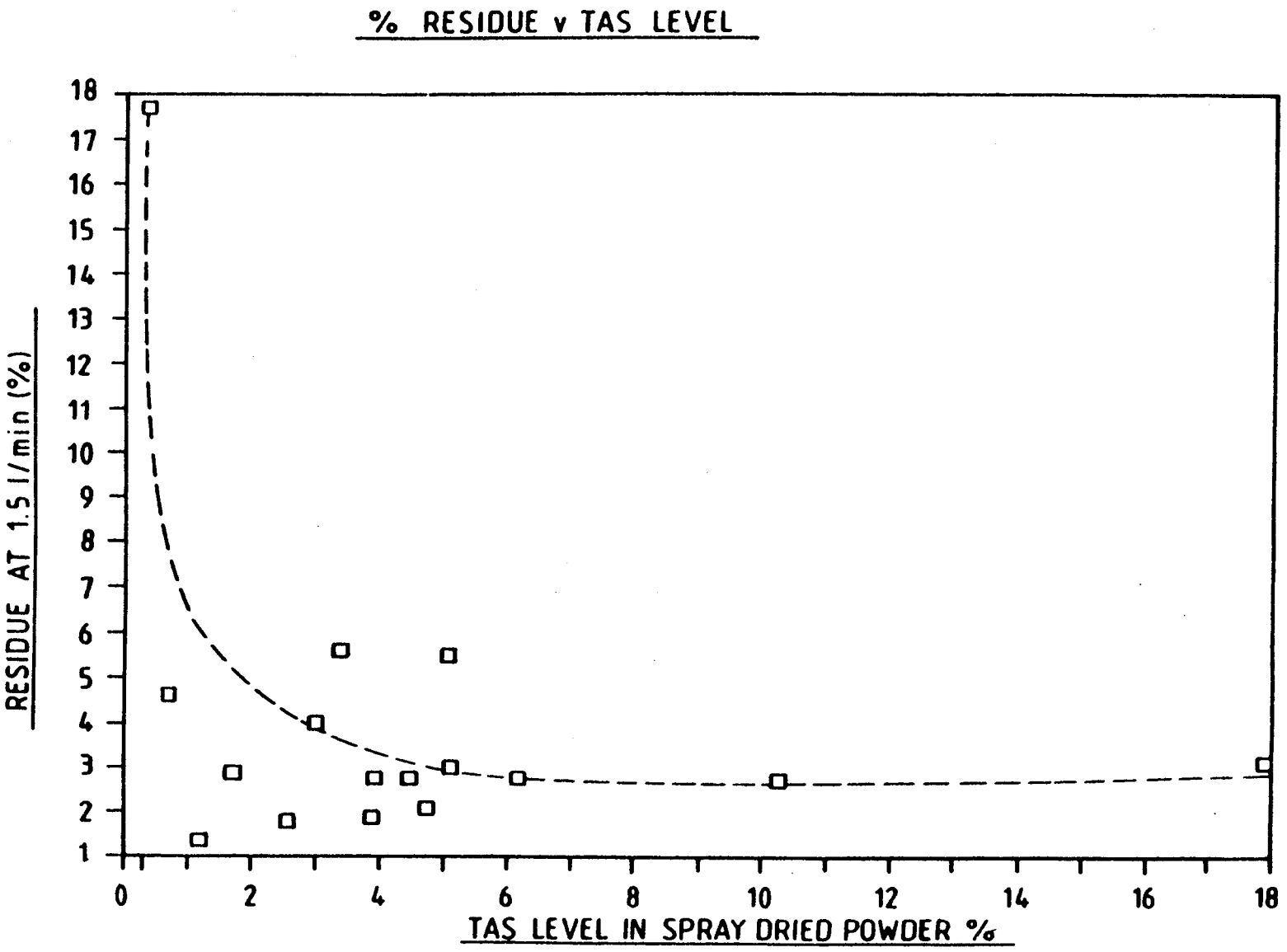
FIG. 4 is a plot showing the effect on the Residue Index of sodium tallow alkyl sulfate level in a spray dried detergent powder.

FIG. 4 shows the effect of tallow alkyl sulfate level in a spray dried powder on the Residue Index, which is a measure of the ability of the powder to be dispensed from a detergent dispenser in an automatic washing machine.

The Residue Index is measured in a test rig which simulates water flow through a detergent dispenser in an automatic washing machine and serves as a means of distinguishing between powders of different dispensing characteristics.

The Residue Index is the weight of product remaining in the container expressed as a percentage of the original charge of product in the container, after completion of a simulated dispensing step under controlled conditions. Low values of the Residue Index indicate good dispensing characteristics for the product concerned whereas high values indicate poor dispensing characteristics.

Figure 7:
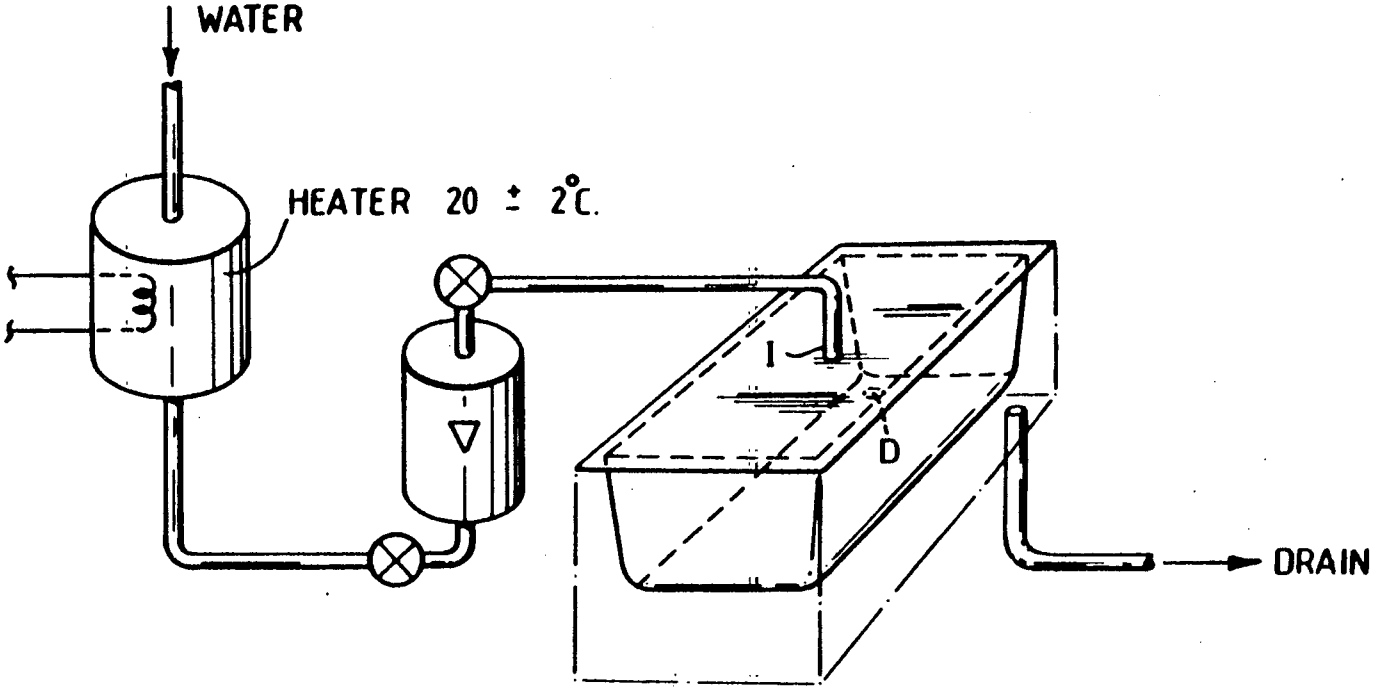
FIG. 7 is a schematic drawing of the apparatus used in the Residue Index Test.

The Test rig is shown schematically in FIG. 7. It comprises a water feed whose characteristics (flow rate, temperature, mineral hardness) can be controlled, an open topped container drawer slidably supported in a housing, and drain means for disposing of the container contents.

The water feed comprises a supply of water of known mineral hardness, a flowmeter to enable the rate of water supply to be controlled at 1.5 liters/min, a thermostatically controlled heater to provide water at 20° C.+2° C. and a vertically downwardly disposed inlet pipe leading to an 8 mm dia. inlet I located in the roof of the housing on the longitudinal center line and 105 mm from the front of the housing. The container is 235 mm long, 70 mm wide and 57.5 mm deep and the transition from the base to both end walls and the RH wall is curved with a radius of 17.5 mm. A discharge opening D of diameter 25 mm is provided at the rear LH corner of the base of the container and the housing has corresponding drain openings and pipework to remove the product-water mixture.

The Test procedure involves weighing the empty container, charging the container with 150 g of the desired product, screened to give particles of particle size p where 1.4 mm >p>0.25 mm, exposing the filled container to a water flow of 1.5 liters/minute for 2 minutes (at a water temperature of 20° C.) and reweighing the container with any wet residual product. The Residue Index (RI) is expressed as $$\frac{\text{Final Wt of container (g)} - \text{wt of empty container (g)}}{150} \times 100$$

Before the container is charged, a plug having the dimensions of the internal cross section of the container is inserted at a point 125 mm from the front of the container. The powder is charged into the front part of the container and levelled and the plug then removed.

This procedure serves to standardise the location of the powder in the container prior to the test and simulates the manner in which detergent product is disposed in practice in the dispensing compartment of an automatic washing machine.

Referring again to FIG. 4, it can be seen that Tallow alkyl sulfate levels in excess of about 0.75% by weight in the spray dried powder give Residue Index values in the range 1.5–5.5 although the empirical nature of the Test gives rise to some scatter.

Figure 5:
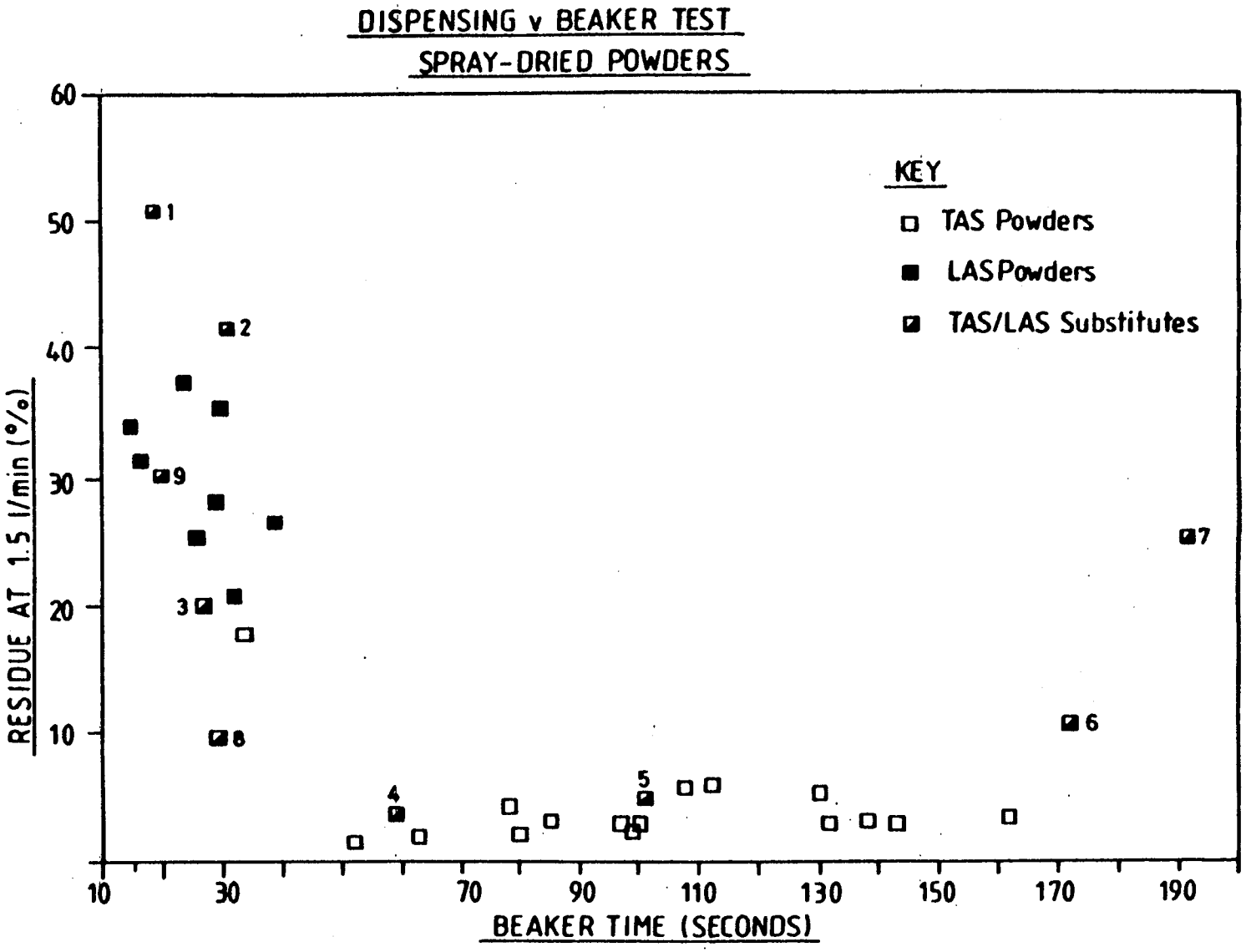
FIG. 5 shows the relationship between 95% solubility time ($T_{95}$) values and Residue Index values for a variety of spray dried powders.

The correlation of this Test with the $T_{95}$ values can be seen in FIG. 5 in which the Residue Index is plotted against $T_{95}$ value for a number of spray dried powder products having a particle size p where 1.4 mm >p>0.25 mm. Three types of product are illustrated, namely, powders with LAS as the sole surfactant, powders with TAS as the sole surfactant and powders with various substitutes for these surfactants. The data points for the substitutes are numbered and correspond to the following products.

| | |
|---|---|
| 1. microcrystalline wax | 2.1% |
| 2. $C_{14-15}$ alcohol (E7) TAS | 3.1%/3.1% |
| 3. $C_{16-18}$ olefin sulfonate | 4.5% |
| 4. Sodium stearate | 2.9% |
| 5. Sodium stearate | 5.6% |
| 6. Sodium $C_{18-22}$ fatty acid salt | 3.05% |
| 7. $C_{18-22}$ fatty acid | 3.04% |
| 8. Sodium $C_{14}$–$C_{15}$ alkyl sulfate | 4.0% |
| 9. Sodium paraffin sulfonate | 4.1% |

It can be seen that a clear relationship exists between the two parameters, high $T_{95}$ values (i.e. in excess of 40 seconds) being associated with low RI values and vice versa.

The addition of the second component causes the Residue Index to increase, the extent of the increase being a function of the physical and chemical nature of, and the amount of, the second component. Curve 1 in FIG. 6 illustrates the effect of varying ratios of Tallow alkyl sulfate (TAS) spray dried powder component and an agglomerated component based on a $C_{11.8}$ sodium linear alkyl benzene sulfonate (LAS) surfactant, the two components having the formulations shown below.

| Ingredient | Parts by Weight |
|---|---|
| First Component: | |
| TAS | 5.34 |
| STPP | 46.30 |
| Sodium Sulphate | 30.03 |
| $H_2O$ | 11.98 |
| Maleic anhydride-acrylate copolymer sodium salt MWT≈60,000 | 3.95 |
| Sodium Diethylene Triamine Penta methylene phosphonate | 0.52 |
| EDTA | 0.63 |
| CMC | 0.93 |
| Brightener | 0.32 |
| | 100.00 |
| Second Component: | |
| LAS | 23.5 |
| Sodium Carbonate | 30.9 |
| Sodium Zeolite A | 17.6 |
| Silicate, 3:2 Ratio | 16.5 |
| $H_2O$ | 8.0 |
| Miscellaneous | 3.5 |
| | 100.0 |

Figure 6:
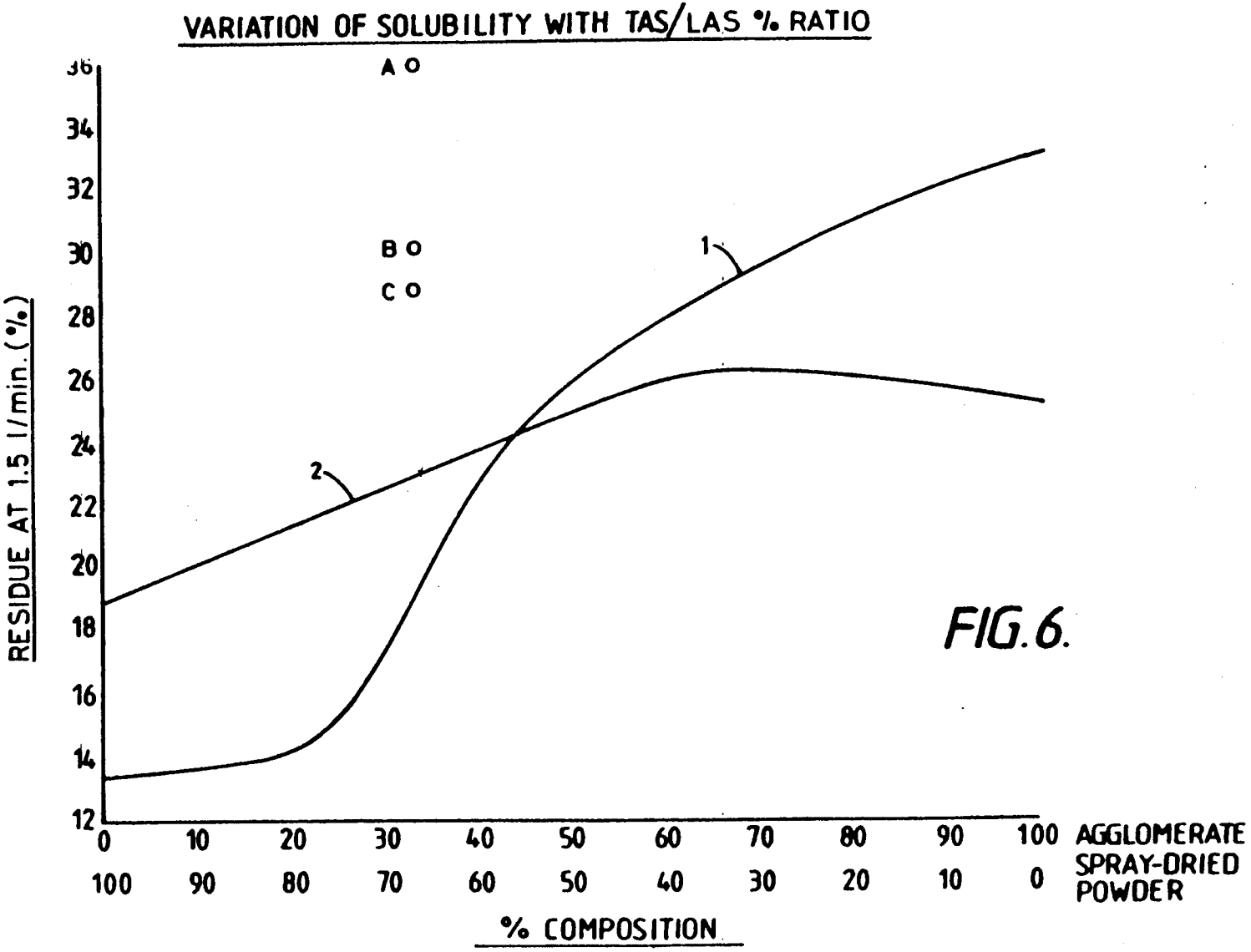
FIG. 6 illustrates the relationship between solubility time ($T_{95}$) values and Residue Index values for a detergent product comprising varying proportions of spray dried powder and agglomerated components.

FIG. 6 also shows (in Curve 2) the effect of adding further dry mixed ingredients of the type normally incorporated in laundry detergents. This curve shows the Residue Index obtained from a fully formulated laundry detergent product in which the components forming the product of Curve 1 were blended with a filed amount of sodium perborate bleach, bleach activator, sodium sulphate and an enzyme prill as shown below.

| DRY ADDITIVES: | |
|---|---|
| Sodium perborate tetrahydrate | 48.0 |
| Sodium perborate Monohydrate | 7.2 |
| Sodium sulfate | 36.4 |
| 87% Tetraacetyl ethylene diamine/13% TAE25 particulate | 8.4 |
| | 100.0 |
| Component 1 & Component 2 = | 71.2% |
| Dry Additives = | 28.8 |
| | 100.0% |

The change in Residue Index with change in ratio of the first and second components still exists but to a reduced extent. However the practical dispensing benefit provided by compositions in accordance with the invention in which defined surfactants are separated from each other can be seen by reference to the dispensing performance of comparative formulations A, B and C in which the surfactants are present in a single granule.

This benefit is particularly noticeable in compositions having bulk densities in excess of 600 g/liter, as increases in density of the first and second components do not have an adverse effect on the dispensing characteristics in contrast to prior art compositions containing the surfactant(s) comprising a spray dried component together with dry mixed heat or chemically sensitive components.

The invention is illustrated in the following non-limitative examples in which all percentages are by weight unless stated otherwise.

EXAMPLE 1

A solid detergent composition was made as follows:

| FIRST COMPONENT: | Parts |
|---|---|
| TAS | 2.55 |
| STPP | 22.09 |
| Sodium Sulphate | 14.33 |
| Water | 5.71 |
| Maleic anhydride acrylate copolymer sodium salt MWT ≈ 60,000 | 1.88 |
| Sodium diethylene triamine penta methylene phosphonate | 0.25 |
| EDTA | 0.30 |
| CMC | 0.45 |
| Brightener | 0.15 |
| | 47.71 |

A homogeneous aqueous slurry of the components shown above was made up with a moisture content of 35–38%. The slurry was heated to 90° C. and fed under high pressure, (5,515–6,894 kPa), into a conventional counter-current spray dryinq tower with an inlet temperature of 182–193° C. The atomised slurry was dried to produce a granular solid which was then cooled and sieved to remove oversize (>1.4 mm) and fine (<0.5 mm) material. The finished granules had a moisture content of about 11% by weight, a bulk density of 638 g/liter and a particle size distribution such that 68% by weight of the granules were between 250–700 μ in size.

This powder had a $T_{95}$ of 50 secs.

This component then formed the base material into which the second component and the other dry mixed components were added.

| SECOND COMPONENT: | Parts |
|---|---|
| LAS | 5.60 |
| Sodium Carbonate | 7.36 |
| Sodium silicate ($SiO_2$:$Na_2O$ = 3.2:1) | 3.93 |
| Zeolite A | 4.19 |
| Miscellaneous | 2.74 |
| | 20.14 |

This was prepared by contacting a mixture of sodium silicate, sodium carbonate and Zeolite A with a commercially available grade of dodecyl benzene sulfonic acid (95% active). The powdered sodium carbonate and Sodium Zeolite A were fed continuously to a high intensity Lodige mixer and then contacted with the acid which was introduced through an open ended pipe inserted tangentially in the shell of the mixer. The ratio of liquid to powder was controlled to achieve good granulation of the powder without producing a critically wet mass.

The contact time in the mixer was relatively short in comparison to reaction time required for complete neutralisation of the acid. Therefore the fresh product was placed in a batch mixer and provided with gentle agitation for five minutes to allow dynamic aging of the product. The resultant product was a free flowing granulate with a particle size distribution in which 1.1% of the material was >1.4 mm and 10.7% <0.15 mm, with a bulk density of 750 $gl^{-1}$.

This was then post dosed with the other dry mixed components to the spray dried component.

| DRY COMPONENTS: | |
|---|---|
| Sodium perborate tetra hydrate | 13.70 |

-continued

| DRY COMPONENTS: | |
|---|---|
| Sodium perborate mono hydrate | 2.03 |
| Sodium sulphate | 9.51 |
| Bleach Activator particles (87% TAED 13% TAE25 as binder) | 2.39 |
| Enzyme Prill | 0.84 |
| | 28.47 |
| COMPOSITION TOTAL PARTS (First component + second component + dry components) | 100.00 |

The total composition had a bulk density of 785 g/liter and in the RESIDUE INDEX test the RI of this composition was found to be 14.6%.

EXAMPLE 2

A solid detergent composition was made having the following formulation:

| FIRST COMPONENT 1 Composition | |
|---|---|
| TAS | 2.66 |
| Zeolite A | 21.60 |
| Sodium sulphate | 7.00 |
| Water | 5.88 |
| Sodium polyacrylate (MWT ≈ 2,000) | 4.11 |
| Maleic anhydride - acrylate copolymer sodium salt (MWT ≈ 60,000) | 0.17 |
| EDTA | 0.26 |
| CMC | 0.46 |
| Brightener | 0.16 |
| | 42.30 |

This component was made using a similar technique to that employed in Example 1 and the spray dried powder had a bulk density of 582 g/liter with a particle size distribution in which 56.3% of the powder was between 0.4525 and 0.25 mm in size. The $T_{95}$ value for this powder was 130 seconds.

| SECOND COMPONENT: | |
|---|---|
| LAS | 5.98 |
| Sodium Carbonate | 7.86 |
| Zeolite A | 4.47 |
| Sodium Silicate ($SiO_2$:$Na_2O$ = 3.2:1) | 4.20 |
| Miscellaneous | 2.93 |
| | 25.44 |

This was prepared by contacting a mixture of sodium carbonate, 3.2 ratio sodium silicate and Zeolite A with a commercially available grade of dodecyl benzene sulphonic acid (96% active). The three powdered components were pre-mixed and were fed continuously to a high intensity Lodige mixer to be contacted with the acid which was introduced through an open ended pipe inserted tangentially in the shell of the mixer. The ratio of liquid to powder was controlled to achieve good granulation of the powder.

The contact time in the mixer was relatively short in comparison to reaction time required for complete neutralisation of the acid. Therefore the fresh product was placed in a batch mixer and provided with gentle agitation for five minutes to allow dynamic aging of the product. The resultant product was a free flowing granulate with particle size distribution in which 1.1% of the material was >1.4 mm and 10.7%<0.15 mm, with a bulk density of 750 $gl^{-1}$.

This was then post dosed with the other dry mixed additives to the spray dried component.

| DRY ADDITIVES | |
|---|---|
| Sodium Perborate Tetrahydrate | 15.82 |
| Sodium Perborate Monohydrate | 1.58 |
| Sodium Carbonate | 5.75 |
| Bleach activator particles (87% TAED 13% TAE25) | 2.62 |
| Terephthalic acid-propylene glycol-ethylene glycol copolymer of MWT ≈ 5000 | 3.90 |
| AE1 Prills | 2.58 |
| | 32.26 |
| TOTAL PARTS (First component + second component + dry additives) | 100.00 |

This composition had a bulk density of 690 g/liter and when subjected to the RESIDUE INDEX test had a RI value of 28.0%.

We claim:

1. A solid detergent composition, wherein said composition is composed of at least two particulate multi ingredient components, a first one of said components consisting essentially of, by weight, a spray dried particulate incorporating an anionic surfactant selected from the group consisting of $C_{16}$–$C_{22}$ alkyl sulfate salts, $C_{16}$–$C_{24}$ alkyl carboxylate salts, and mixtures thereof, and being substantially free of other anionic surfactants, in an amount of from about 0.75% to about 30% and one or more inorganic and/or organic salts in an amount of from about 99.25% to about 70%, said composition optionally including additional dry mixed detergent ingredients wherein;

(a) said first component comprises from about 30% to about 99% by weight of the composition and has a $T_{95}$ value of from about 40 to about 180, $T_{95}$ being the time in seconds to achieve 95% solution of a 1% weight mixture of the component in distilled water at 20° C.;

(b) a second component constituting from about 1% to about 70% by weight of the composition consisting essentially of a particulate containing a water soluble surfactant selected from the group consisting of $C_{11}$–$C_{15}$ alkyl benzene sulfonates, $C_{11}$–$C_{15}$ alkyl sulphates, $C_{12}$–$C_{16}$ olefin sulfonates, $C_{11}$–$C_{16}$ paraffin sulphonates, and mixtures thereof; and at least one organic or inorganic salt;

the amounts of (a), (b), and any optional ingredients totalling 100% by weight of the composition, the total composition having a Residue Index of not more than about 30%.

2. A solid detergent composition according to claim 1 wherein the first component comprises from bout 40% to about 60% by weight of the composition, the second component comprises less than about 30% by weight of the composition, and one or more additional dry mixed ingredients are present.

3. A solid detergent composition according to claim 2 wherein the anionic surfactant in the first component is selected from $C_{16}$–$C_{20}$ alkyl sulfates, $C_{18}$–$C_{22}$ fatty acid salts, and mixtures thereof.

4. A solid detergent composition, wherein said composition is composed of at least two particulate multi ingredient components, a first one of said components consisting essentially of, by weight, a spray dried particulate incorporating an anionic surfactant selected from $C_{16}$–$C_{20}$ alkyl sulfates, $C_{18}$–$C_{22}$ fatty acid salts, and mixtures thereof, and being substantially free of other anionic surfactants, in an amount of from about 0.25% to about 25% and one or more inorganic and/or organic salts in an amount of from about 97.5% to about 75%, said composition optionally including additional dry mixed detergent ingredients wherein;

(a) said first component comprises from about 30% to about 99% by weight of the composition and has a $T_{95}$ value of from about 40 to about 180, $T_{95}$ being the time in seconds to achieve 95% solution of a 1% weight mixture of the component in distilled water at 20° C.;

(b) a second component constituting from about 1% to about 70% by weight of the composition consisting essentially of a non-spray dried, mechanically mixed agglomerate containing a water soluble surfactant selected from the group consisting of $C_{11}$–$C_{15}$ alkyl benzene sulfonates, $C_{11}$–$C_{15}$ alkyl sulphates, $C_{12}$–$C_{16}$ olefin sulfonates, $C_{11}$–$C_{16}$ paraffin sulphonates, and mixtures thereof; and at least one organic or inorganic salt;

the amounts of (a), (b) and any optional ingredients totalling 100% by weight of the composition, the total composition having a Residue Index of not more than about 30%.

5. A solid detergent composition according to claim 4 wherein the first component comprises from about 40% to about 60% by weight of the composition, the second component comprises less than about 30% by weight of the composition, and one or more additional dry mixed ingredients are present.

6. A solid detergent composition according to claim 5 wherein the additional dry mixed ingredient is any one or more of the particulate inorganic peroxy bleach, suds suppressor, polymeric soil release agent, fabric softener, enzyme, photoactivated bleach, perfume and dye materials.

7. A solid detergent composition according to claim 6 wherein, in addition to an inorganic peroxy bleach particulate component, there is also a particulate organic peroxy carboxylic acid precursor component.

8. A solid detergent composition according to claim 5 wherein the inorganic salt in the first component is a detergent builder salt.

9. A solid detergent composition according to claim 8 wherein the builder salt is selected from sodium tripolyphosphate, zeolite A, B or X and mixtures of any of the foregoing.

10. A detergent composition according to claim 5 wherein the bulk density of the composition is at least 650 g/liter 11. A solid detergent according to claim 5 wherein the particles of the second component are provided with a coating comprised of fine particles of said spray dried powder, said fine particles being of size less than 150μ.

* * * * *